US007713147B1

(12) United States Patent
Tapia

(10) Patent No.: US 7,713,147 B1
(45) **Date of Patent: *May 11, 2010**

(54) GOLF TEE CLIP

(76) Inventor: Victor Tapia, 6780 SW. 185 Way, South West Ranches, FL (US) 33332

( * ) Notice: Subject to any disclaimer, the term of this patent is extended or adjusted under 35 U.S.C. 154(b) by 0 days.

This patent is subject to a terminal disclaimer.

(21) Appl. No.: 12/275,469

(22) Filed: Nov. 21, 2008

(51) Int. Cl.
*A63B 57/00* (2006.01)

(52) U.S. Cl. ..... 473/387; 473/257

(58) Field of Classification Search ..... 473/387–403, 473/257; D21/717, 718
See application file for complete search history.

(56) References Cited

U.S. PATENT DOCUMENTS 1,779,995 A * 10/1930 Trane ..... 473/398
D181,338 S * 11/1957 Beckwith ..... D21/718
3,424,457 A * 1/1969 Robertson ..... 473/388
4,205,841 A * 6/1980 Silva et al. ..... 473/392
D307,929 S * 5/1990 Parkerson ..... D21/791
5,240,254 A * 8/1993 Adlam ..... 473/396
5,437,448 A * 8/1995 Balson ..... 473/396
D385,939 S * 11/1997 Suk ..... D21/794
6,056,651 A * 5/2000 Malinoff ..... 473/400
6,494,796 B2 * 12/2002 Echaves ..... 473/393
D490,133 S * 5/2004 Hadala ..... D21/717
D491,990 S * 6/2004 Lu ..... D21/717
D602,102 S * 10/2009 Tapia ..... D21/717

FOREIGN PATENT DOCUMENTS

GB 2103493 A * 2/1983
WO WO 9406520 A1 * 3/1994
WO WO 2005056126 A1 * 6/2005

* cited by examiner

*Primary Examiner*—Steven Wong
(74) *Attorney, Agent, or Firm*—Ruben Alcoba, Esq.

(57) ABSTRACT

A clip, the clip attaches to a standard golf tee. The clip provides alignment to the target, the clip reduces the resistance normally created by a tee when a ball is hit off of a standard golf tee. The clip normally snaps off the cup of a standard golf tee when a golf ball is hit. By allowing the clip to snap off the cup of a standard golf tee, resistance is reduced.

6 Claims, 4 Drawing Sheets

GOLF TEE CLIP

BACKGROUND

The present invention relates to a clip that attaches to the tip of a standard golf tee.

The inventor of the present invention enjoys playing golf, yet he is not a professional. He realized that often, when he hit the ball off a standard golf tee, his shots would somewhat deviate from the intended target. The reasons his shots would deviate are twofold: first, because of the resistance caused by his golf club hitting the golf tee; and second, because of his stance not being square with the line of the intended target. In addition, he also realized that when he hit the golf tee upon hitting the ball, the distance the ball traveled was reduced. This caused him to ponder how to improve the standard golf tee so that when a ball was hit off a golf tee the head of the golf club would hit the ball prior to hitting the golf tee and at the same time provide guidance for the correct stance to be inline with the intended target. By having an arrow on the golf clip pointing toward the intended target and hitting the ball prior to hitting the golf tee, resistance caused by the tee would be minimized and direction to the target would be improved, thereby eliminating deviations normally associated with using a standard golf tee and in turn increasing the distance the ball would travel.

The inventor first decided to change the existing design of current golf tees so that the stem of standard golf tees and the cup of the tees would not be linearly aligned. He realized that he had to place the cup a certain distance from the central axis of the stem. By doing this he would increase the probability of hitting the golf ball prior to hitting the stem of the tee. The problem with this design was that when he hit the ball off the tee, the tee was also impacted, thereby breaking or lifting the tee off the ground and causing resistance.

This is when the inventor realized that the ideal modification to a golf tee was not to change the design of the tee, but to add a removable clip to a standard golf tee. The clip would have to be designed to easily come off the tee when a ball is hit.

The inventor further realized that if he could place a pointing arrow on the golf clip that he could use the golf clip as a means for aligning his shot prior to setting up before the tee.

An object of the present invention is to provide a clip that attaches to a standard golf tee that will provide alignment to the target and reduce some of the deviation created when a golf ball is hit off a standard golf ball tee.

A further object of the present invention is to provide a clip that attaches to a standard golf tee that will increase the distance a ball travels by reducing the resistance normally created when a golf ball is hit off a standard golf tee.

Another object of the present invention is to provide a clip that attaches to a standard golf tee that will allow a user to align his shot prior to setting up before the tee.

Other objects of the invention will become apparent in view of the following description taken in connection with the accompanying drawings.

SUMMARY

The present invention is directed to a clip that attaches to a standard golf tee. The clip provides alignment to the target and reduces the resistance normally created by a tee when a ball is hit off a standard golf tee. The clip normally snaps off the cup of a standard tee when a golf ball is hit. By hitting the ball a fraction of a second before hitting the tee and allowing the clip to snap off the cup of a standard golf tee, resistance is reduced.

A clip that attaches to a standard golf tee having features of the present invention comprises a rectangular planar body measuring at least two inches from end to end, the body having a top surface, a bottom surface, a first end, a second end, and a central axis, the body defining a first and a second curved arm, each arm having a first end and a second end, the first end of each arm attaches to the ends of the body so that an angle of at least ten degrees is created between the bottom surface of the body and the first end of each curved arm, the curved arms flow towards the central axis of the body up to a point that is at least one quarter of an inch from the central axis of the body and then the second end of each arm curves outward from the bottom surface of the body so that the second end of each arm is at least one eighth of an inch from the central axis of the body and the end of each arm is substantially perpendicular to the bottom surface of the body, a cup, the cup attaches to the top surface of the body at a position adjacent to the first end of the body, wherein half of the cup rests on the body and the other half extends outward from the body. The body might further comprise of a pointer, the pointer is defined on the top surface of the body. The pointer flows from where the cup attaches to the body and runs toward the second end of the body.

The bottom surface of the body along with the second end of each arm define an aperture. The aperture would house a standard golf tee.

The present invention is used by first housing the cup of a standard golf tee within the aperture of the clip. Then inserting the golf tee and clip in a ground surface. Then aligning the pointing device of the clip in a certain direction. Next, centrally aligning oneself parallel to the pointing device of the clip. Lastly, hitting the ball off the clip.

DRAWINGS

These and other features, aspects, and advantages of the present invention will become better understood with regard to the following description, appended claims, and drawings where:

WRITTEN DESCRIPTION

As seen in FIGS. 1-4, a clip that attaches to a standard golf tee, the clip comprises a rectangular planar body 10 measuring at least two inches, the body 10 having a top surface, a bottom surface, a first end 10*b*, a second end 10*a*, and a central axis, the body 10 defining a first 10*c* and a second curved arm 10*d*, each arm 10*c*/10*d* having a first end and a second end, the first end of each arm 10*c*/10*d* attaches to the ends of the body 10*a*/10*b* so that an angle of at least ten degrees is created between the bottom surface of the body 10 and the first end of each curved arm 10*c*/10*d*, the curved arms 10*c*/10*d* flow towards the central axis of the body 10 up to a point that is at least one quarter of an inch from the central axis of the body 10 and then the second end of each arm 10*c*/10*d* curves outward from the bottom surface of the body 10 so that the second end of each arm 10*c*/10*d* is at least one eighth of an inch from the central axis of the body 10 and the end of each arm 10*c*/10*d* is substantially perpendicular to the bottom surface of the body 10, a cup 12, the cup 12 attaches to the top surface of the body at a position adjacent to the first end 10*b* of the body, wherein half of the cup 12 rests on the body and the other half extends outward from the body 10. The second end 10*a* of the body might be pointed. The body 10 might further comprise of a pointer 14, the pointer 14 is defined on the top surface of the body 10, the pointer 14 flows from wherein the cup 12 attaches to the body 10 and runs toward the second end of the body 10.

Figure 1:
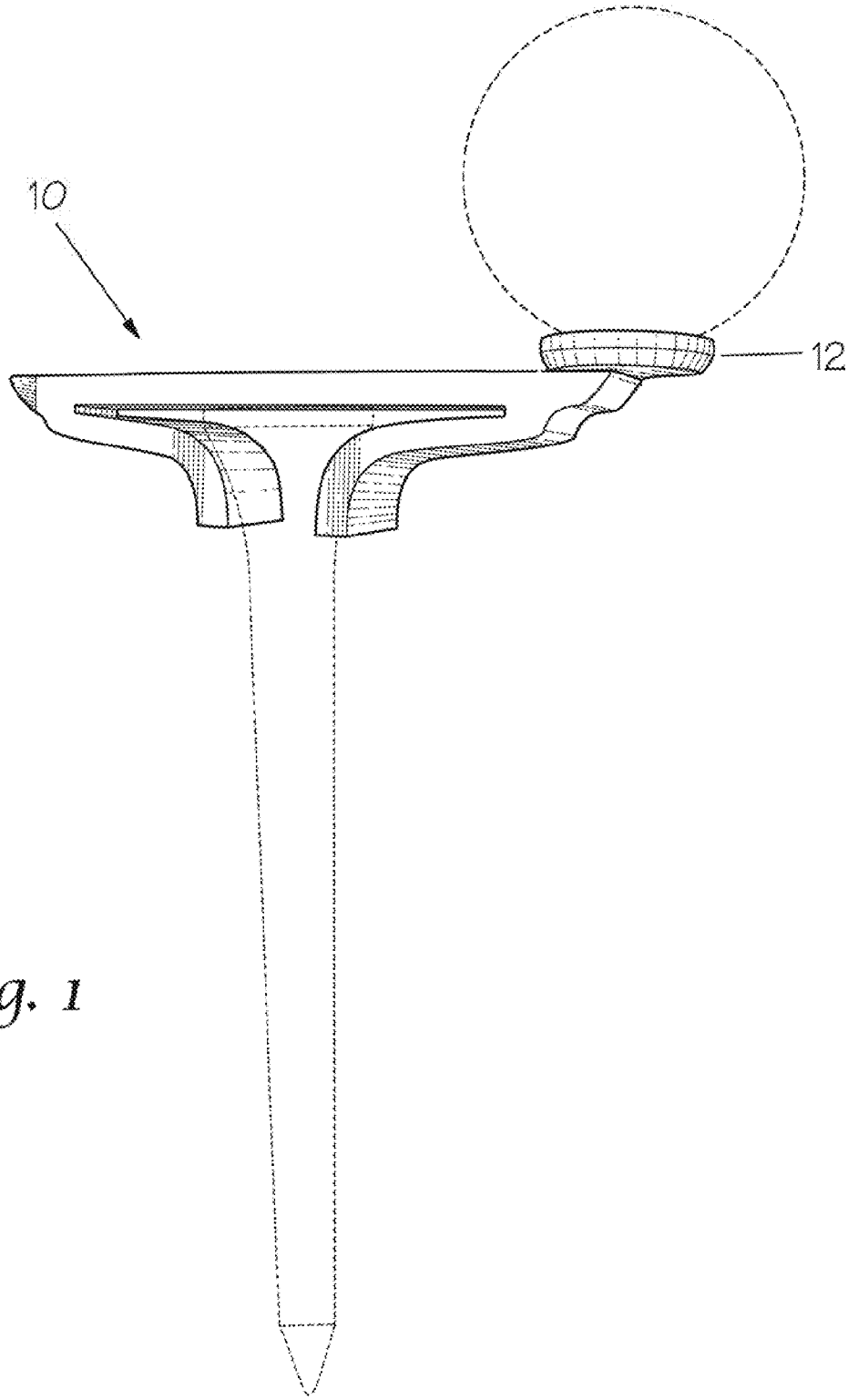
FIG. 1 shows a perspective view of the clip mounted on an existing golf tee with a ball on the cup of the clip.
Figure 2:
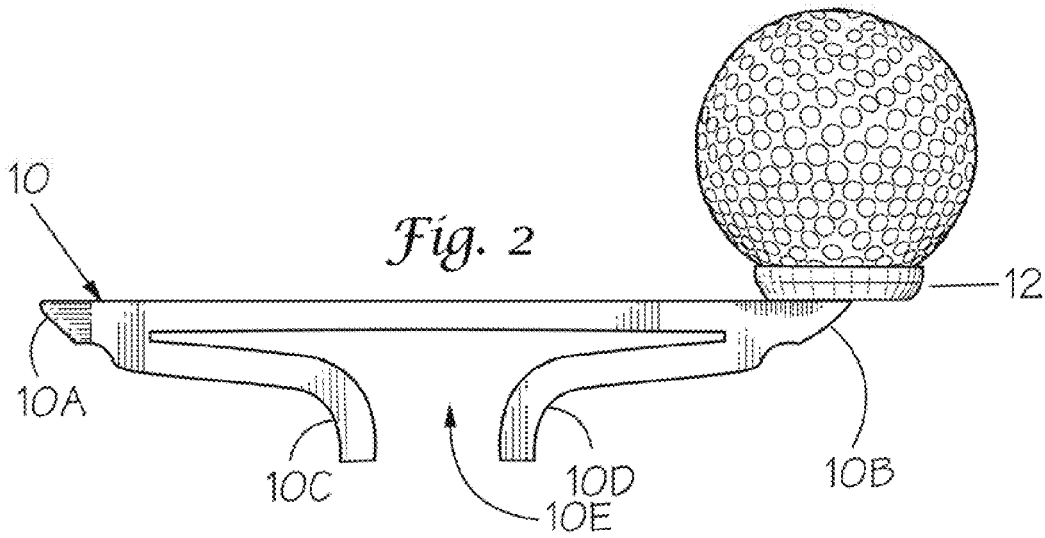
FIG. 2 shows a side view of the clip shown in FIG. 1 with a golf ball on top of the cup of the tee.
Figure 3:
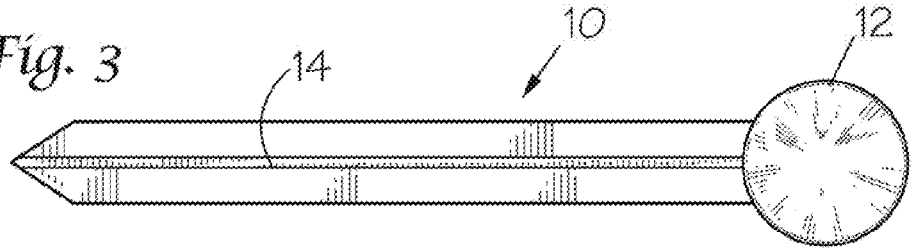
FIG. 3 shows a top plan view of the clip shown in FIG. 1 showing a pointing device of the clip.
Figure 4:
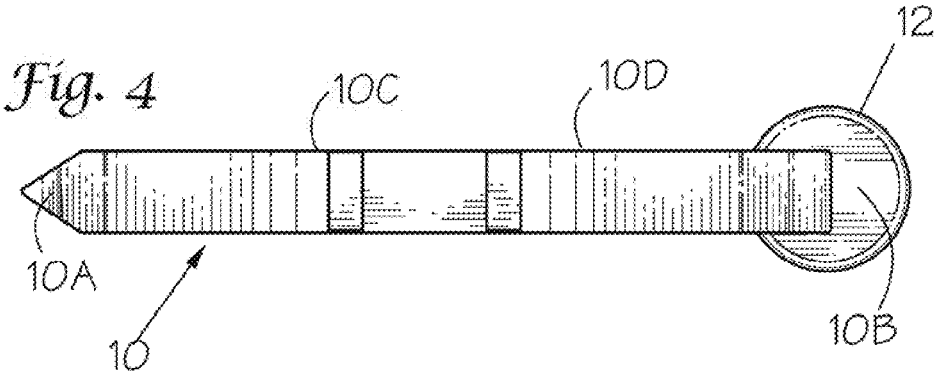
FIG. 4 shows a bottom view of the clip shown in FIG. 1.
Figure 5:
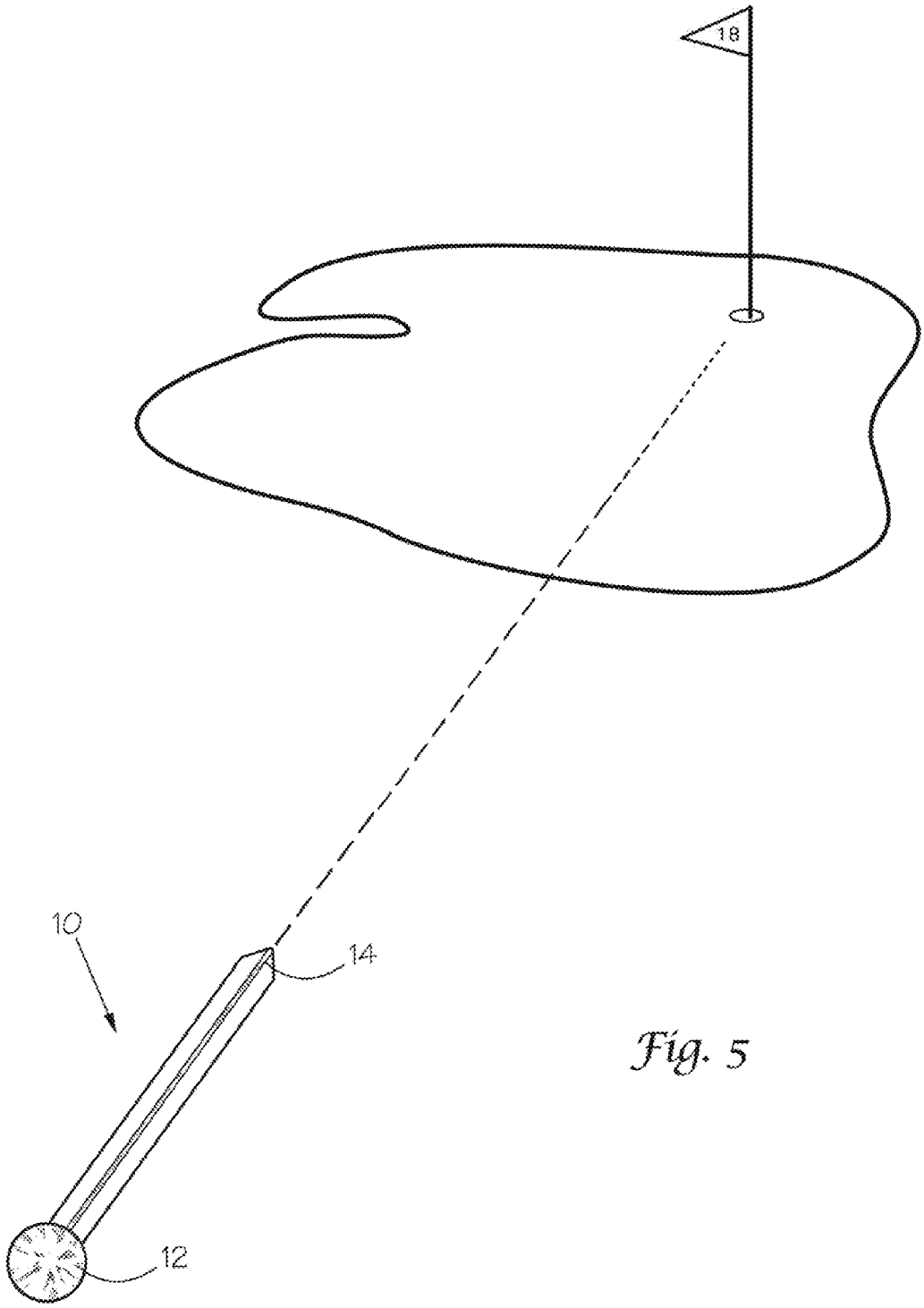
FIG. 5 shows how the pointing device of the clip shown in FIG. 1 would be aimed at a target.
Figure 6:
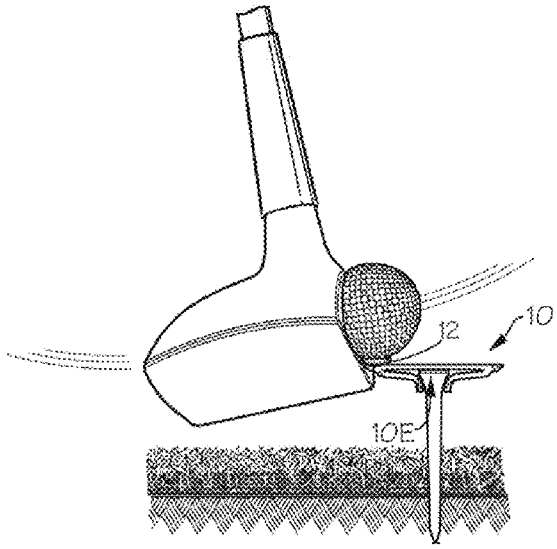
FIG. 6 shows how a golf ball would be hit off the clip shown in FIG. 1.
Figure 7:
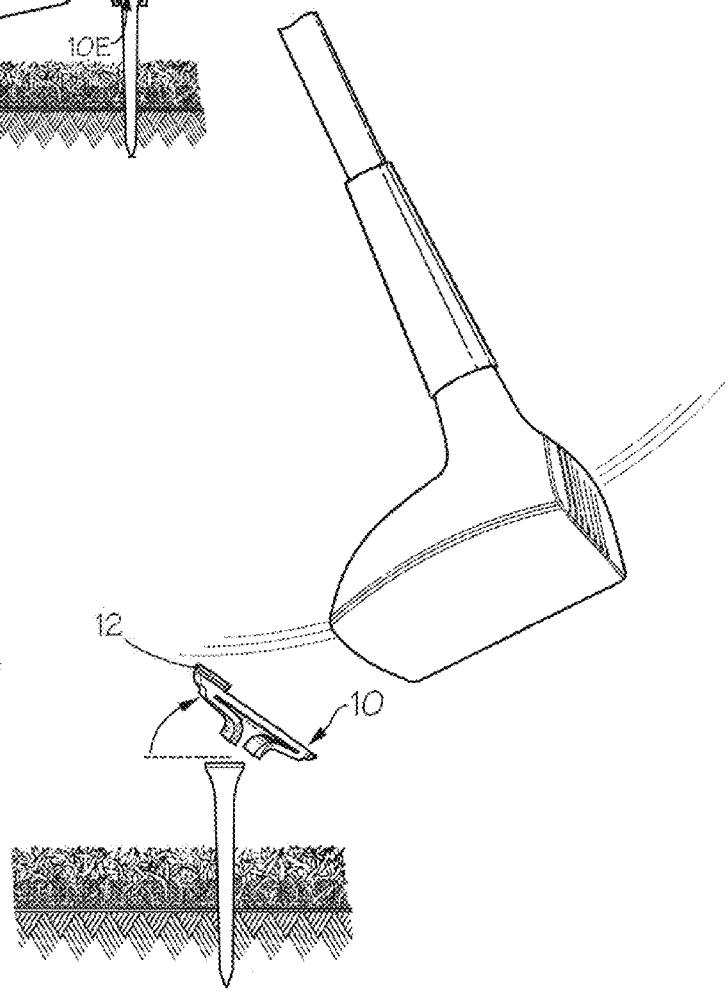
FIG. 7 shows how the clip would snap off an existing golf tee after a ball is hit off the cup of the clip shown in FIG. 1.

It is important to note, as seen in FIG. 2, that the bottom surface of the body 10 along with the second ends of each 10*c*/10*d* arm define an aperture 10*e* wherein the cup of a standard golf tee is housed.

The present invention is made of either wood, aluminum compound, or any synthetic plastic polymer. In a preferred embodiment, the invention would be made of a resilient plastic polymer.

As seen in FIG. 1 and FIGS. 5-7, the present invention is used by first housing the cup of a standard golf tee within the aperture of the clip 10*e*. Then inserting the golf tee and clip 10 on a surface. Then providing a golf ball. Next, placing a golf ball on the cup 12 of the clip 10. Then, aligning the pointer 14 of the clip towards a target. Next, aligning oneself before the clip 10. And lastly, hitting the golf ball off the cup 12 of the clip 10 toward the direction of the target.

An advantage of the present invention is that it provides a clip that attaches to a standard golf tee that reduces deviations created when a golf ball is hit off a standard golf ball tee.

A further advantage of the present invention is that it provides a clip that attaches to a standard golf tee that increases the distance a ball travels by reducing the resistance normally created when a golf ball is hit off a standard golf tee.

Another advantage of the present invention is that it provides a clip that attaches to a standard golf tee that allows a user to align his shot prior to setting up before the tee.

While we have shown and described the embodiment in accordance with the present invention, it should be clear to those skilled in the art that further embodiments may be made without departing from the scope of the present invention.

What is claimed is:

1. A clip that attaches to a standard golf tee, the clip comprises:

a planar body measuring at least two inches from end to end, the body having a top surface, a bottom surface, a first end, a second end, and a central axis, the body defining a first and a second curved arm, each arm having a first end and a second end, the first end of each arm attaches to the ends of the body so that an angle of at least ten degrees is created between the bottom surface of the body and the first end of each curved arm, the curved arms flow towards the central axis of the body up to a point that is at least one quarter of an inch from the central axis of the body and then the second end of each arm curves outward from the bottom surface of the body so that the second end of each arm is at least one eighth of an inch from the central axis of the body and the end of each arm is substantially perpendicular to the bottom surface of the body; and a cup, the cup attaches to the top surface of the body at a position adjacent to the first end of the body, wherein half of the cup rests on the body and the other half extends outward from the body.

2. The clip of claim 1, wherein the second end is pointed.

3. The clip of claim 2, further comprising a pointer, the pointer is defined on the top surface of the body, the pointer flows from wherein the cup attaches to the body and runs toward the pointed end of the body.

4. The clip of claim 3, wherein the clip is made of a resilient material.

5. The clip of claim 4, wherein the material is a plastic polymer.

6. A method of using the clip defined in claim 3, comprising the steps of:

providing a standard golf tee;

providing the clip;

housing the cup of the standard golf tee within the aperture of the clip;

inserting the golf tee with the clip into a ground surface;

providing a golf ball;

placing a golf ball on the cup of the clip;

aligning the pointer of the clip towards a target;

aligning oneself before the clip; and hitting the golf ball off the cup of the clip toward the direction of the target.

* * * * *